US009828867B2

(12) United States Patent
Budnick

(10) Patent No.: US 9,828,867 B2
(45) Date of Patent: Nov. 28, 2017

(54) BUMPER FOR SEALS IN A TURBINE EXHAUST CASE

(71) Applicant: United Technologies Corporation, Hartford, CT (US)

(72) Inventor: Matthew Budnick, Hudson, NH (US)

(73) Assignee: United Technologies Corporation, Farmington, CT (US)

( * ) Notice: Subject to any disclaimer, the term of this patent is extended or adjusted under 35 U.S.C. 154(b) by 280 days.

(21) Appl. No.: 14/655,625

(22) PCT Filed: Jan. 23, 2013

(86) PCT No.: PCT/US2013/022700
§ 371 (c)(1),
(2) Date: Jun. 25, 2015

(87) PCT Pub. No.: WO2014/105100
PCT Pub. Date: Jul. 3, 2014

(65) Prior Publication Data
US 2015/0354384 A1 Dec. 10, 2015

Related U.S. Application Data

(60) Provisional application No. 61/747,228, filed on Dec. 29, 2012.

(51) Int. Cl.
*F01D 11/00* (2006.01)
*F01D 25/30* (2006.01)

(52) U.S. Cl.
CPC ..... *F01D 11/003* (2013.01); *F01D 11/005* (2013.01); *F01D 25/30* (2013.01)

(58) Field of Classification Search
CPC ..... F01D 11/003; F01D 11/005; F01D 25/30; F05D 2240/55
USPC ..... 477/591, 959, 596, 555, 964
See application file for complete search history.

(56) References Cited

U.S. PATENT DOCUMENTS 2,214,108 A 9/1940 Grece
3,576,328 A 4/1971 Vose
3,754,766 A * 8/1973 Asplund ..... F16J 15/0887 277/644
3,802,046 A 4/1974 Wachtell et al.
(Continued)

FOREIGN PATENT DOCUMENTS

WO WO 03/020469 A1 3/2003
WO WO 2006/007686 A1 1/2006
(Continued)

OTHER PUBLICATIONS

International Searching Authority, PCT Notification of the Transmittal of the International Search Report and the Written Opinion, dated Jan. 23, 2013, 10 pages.

*Primary Examiner* — Dwayne J White
*Assistant Examiner* — Peter T Hrubiec
(74) *Attorney, Agent, or Firm* — Kinney & Lange, P.A.

(57) ABSTRACT

A turbine seal system comprises a structural frame, a structural member, a seal and a bumper. The structural member is disposed opposite the structural frame. The seal extends between the structural frame and the structural member. The bumper is anchored to the structural frame or the structural member and extends toward a mid-region of the seal. In one embodiment, the structural frame comprises a ring-strut-ring turbine exhaust case.

21 Claims, 6 Drawing Sheets

(56) References Cited

U.S. PATENT DOCUMENTS 3,970,319 A 7/1976 Carroll et al.
4,009,569 A 3/1977 Kozlin
4,044,555 A 8/1977 McLoughlin et al.
4,088,422 A 5/1978 Martin
4,114,248 A 9/1978 Smith et al.
4,305,697 A 12/1981 Cohen et al.
4,321,007 A 3/1982 Dennison et al.
4,369,016 A 1/1983 Dennison
4,478,551 A 10/1984 Honeycutt, Jr. et al.
4,645,217 A 2/1987 Honeycutt, Jr. et al.
4,678,113 A 7/1987 Bridges et al.
4,738,453 A 4/1988 Ide
4,756,536 A 7/1988 Belcher
4,793,770 A 12/1988 Schonewald et al.
4,920,742 A 5/1990 Nash et al.
4,987,736 A 1/1991 Ciokajlo et al.
4,989,406 A 2/1991 Vdoviak et al.
4,993,918 A 2/1991 Myers et al.
5,031,922 A 7/1991 Heydrich
5,042,823 A 8/1991 Mackay et al.
5,071,138 A 12/1991 Mackay et al.
5,076,049 A 12/1991 VonBenken et al.
5,100,158 A 3/1992 Gardner
5,108,116 A 4/1992 Johnson et al.
5,169,159 A 12/1992 Pope et al.
5,174,584 A 12/1992 Lahrman
5,188,507 A 2/1993 Sweeney
5,211,541 A 5/1993 Fledderjohn et al.
5,236,302 A 8/1993 Weisgerber et al.
5,246,295 A 9/1993 Ide
5,265,807 A 11/1993 Steckbeck et al.
5,269,057 A 12/1993 Mendham
5,272,869 A 12/1993 Dawson et al.
5,273,397 A 12/1993 Czachor et al.
5,292,227 A 3/1994 Czachor et al.
5,312,227 A 5/1994 Grateau et al.
5,333,992 A 8/1994 Kane et al.
5,338,154 A 8/1994 Meade et al.
5,357,744 A 10/1994 Czachor et al.
5,370,402 A 12/1994 Gardner et al.
5,385,409 A 1/1995 Ide
5,401,036 A 3/1995 Basu
5,438,756 A 8/1995 Halchak et al.
5,474,305 A 12/1995 Flower
5,483,792 A 1/1996 Czachor et al.
5,558,341 A 9/1996 McNickle et al.
5,597,286 A 1/1997 Dawson et al.
5,605,438 A 2/1997 Burdgick et al.
5,609,467 A 3/1997 Lenhart et al.
5,632,493 A 5/1997 Gardner
5,634,767 A 6/1997 Dawson
5,716,052 A * 2/1998 Swensen ..... F16J 15/0887 277/608
5,755,445 A 5/1998 Arora
5,851,105 A 12/1998 Fric et al.
5,911,400 A 6/1999 Niethammer et al.
5,961,279 A 10/1999 Ingistov
6,095,751 A 8/2000 Kirokawa et al.
6,163,959 A 12/2000 Arraitz et al.
6,196,550 B1 3/2001 Arora et al.
6,227,800 B1 5/2001 Spring et al.
6,343,912 B1 2/2002 Mangeiga et al.
6,358,001 B1 3/2002 Bosel et al.
6,364,316 B1 4/2002 Arora
6,439,841 B1 8/2002 Bosel
6,464,232 B1 10/2002 Marchi et al.
6,511,284 B2 1/2003 Darnell et al.
6,578,363 B2 6/2003 Hashimoto et al.
6,601,853 B2 8/2003 Inoue
6,612,807 B2 9/2003 Czachor
6,619,030 B1 9/2003 Seda et al.
6,637,751 B2 10/2003 Aksit et al.
6,638,013 B2 10/2003 Nguyen et al.
6,652,229 B2 11/2003 Lu
6,672,833 B2 1/2004 MacLean et al.
6,719,524 B2 4/2004 Nguyen et al.
6,736,401 B2 5/2004 Chung et al.
6,792,758 B2 9/2004 Dowman
6,796,765 B2 9/2004 Kosel et al.
6,805,356 B2 10/2004 Inoue
6,811,154 B2 11/2004 Proctor et al.
6,935,631 B2 8/2005 Inoue
6,969,826 B2 11/2005 Trewiler et al.
6,983,608 B2 1/2006 Allen, Jr. et al.
7,055,305 B2 6/2006 Baxter et al.
7,094,026 B2 8/2006 Coign et al.
7,100,358 B2 9/2006 Gekht et al.
7,200,933 B2 4/2007 Lundgren et al.
7,229,249 B2 6/2007 Durocher et al.
7,238,008 B2 7/2007 Bobo et al.
7,367,567 B2 5/2008 Farah et al.
7,371,044 B2 5/2008 Nereim
7,389,583 B2 6/2008 Lundgren
7,614,150 B2 11/2009 Lundgren
7,631,879 B2 12/2009 Diantonio
7,673,461 B2 3/2010 Cameriano et al.
7,677,047 B2 3/2010 Somanath et al.
7,735,833 B2 6/2010 Braun et al.
7,798,768 B2 9/2010 Strain et al.
7,815,417 B2 10/2010 Somanath et al.
7,824,152 B2 11/2010 Morrison
7,891,165 B2 2/2011 Bader et al.
7,909,573 B2 3/2011 Cameriano et al.
7,955,446 B2 6/2011 Dierberger
7,959,409 B2 6/2011 Guo et al.
7,988,799 B2 8/2011 Dierberger
8,069,648 B2 12/2011 Snyder et al.
8,083,465 B2 12/2011 Herbst et al.
8,091,371 B2 1/2012 Durocher et al.
8,092,161 B2 1/2012 Cai et al.
8,152,451 B2 4/2012 Manteiga et al.
8,162,593 B2 4/2012 Guimbard et al.
8,172,526 B2 5/2012 Lescure et al.
8,177,488 B2 5/2012 Manteiga et al.
8,221,071 B2 7/2012 Wojno et al.
8,245,399 B2 8/2012 Anantharaman et al.
8,245,518 B2 8/2012 Durocher et al.
8,282,342 B2 10/2012 Tonks et al.
8,371,127 B2 2/2013 Durocher et al.
8,371,812 B2 2/2013 Manteiga et al.
2003/0025274 A1 2/2003 Allan et al.
2003/0042682 A1 3/2003 Inoue
2003/0062684 A1 4/2003 Inoue
2003/0062685 A1 4/2003 Inoue
2005/0046113 A1 3/2005 Inoue
2005/0242522 A1* 11/2005 Lejars ..... F01D 11/005 277/584
2006/0010852 A1 1/2006 Gekht et al.
2006/0214380 A1 9/2006 Dietle et al.
2008/0216300 A1 9/2008 Anderson et al.
2010/0132371 A1 6/2010 Durocher et al.
2010/0132374 A1 6/2010 Manteiga et al.
2010/0132377 A1 6/2010 Durocher et al.
2010/0202872 A1 8/2010 Weidmann
2010/0236244 A1 9/2010 Longardner
2010/0275572 A1 11/2010 Durocher et al.
2010/0275614 A1 11/2010 Fontaine et al.
2010/0307165 A1 12/2010 Wong et al.
2011/0000223 A1 1/2011 Russberg
2011/0005234 A1 1/2011 Hashimoto et al.
2011/0061767 A1 3/2011 Vontell et al.
2011/0081239 A1 4/2011 Durocher
2011/0081240 A1 4/2011 Durocher et al.
2011/0085895 A1 4/2011 Durocher et al.
2011/0214433 A1 9/2011 Feindel et al.
2011/0262277 A1 10/2011 Sjoqvist et al.
2011/0302929 A1 12/2011 Bruhwiler
2012/0111023 A1 5/2012 Sjoqvist et al.
2012/0156020 A1 6/2012 Kottilingam et al.
2012/0186254 A1 7/2012 Ito et al.
2012/0204569 A1 8/2012 Schubert

(56) References Cited

U.S. PATENT DOCUMENTS

| | | | |
|---|---|---|---|
| 2012/0308367 | A1 | 12/2012 | Luczak |
| 2013/0011242 | A1 | 1/2013 | Beeck et al. |

FOREIGN PATENT DOCUMENTS

| | | | |
|---|---|---|---|
| WO | WO 2009/157817 | A1 | 12/2009 |
| WO | WO 2010/002295 | A1 | 1/2010 |
| WO | WO 2012/158070 | A1 | 11/2012 |

* cited by examiner

BUMPER FOR SEALS IN A TURBINE EXHAUST CASE

BACKGROUND

The present disclosure relates generally to gas turbine engine exhaust cases. More particularly, the present disclosure relates to sealing arrangements between the exhaust case and other structural components of the gas turbine engine.

Turbine Exhaust Cases (TEC) typically comprise structural frames that support the very aft end of a gas turbine engine. In aircraft applications, the TEC can be utilized to mount the engine to the aircraft airframe. In industrial gas turbine applications, the TEC can be utilized to couple the gas turbine engine to an electrical generator. A typical TEC comprises an outer ring that couples to the outer diameter case of the low pressure turbine, an inner ring that surrounds the engine centerline so as to support shafting in the engine, and a plurality of struts connecting the inner and outer rings. As such, the TEC is typically subject to various types of loading, thereby requiring the TEC to be structurally strong and rigid. Due to the placement of the TEC within the hot gas stream exhausted from a combustor of the gas turbine engine, it is typically desirable to shield the TEC structural frame with a fairing that is able to withstand direct impingement of the hot gases. The fairing additionally takes on a ring-strut-ring configuration wherein the struts are hollow to surround the frame struts. The structural frame and the fairing can each be made of materials optimized for their respective functions.

When mounting the TEC to other structural components of a gas turbine engine, such as a casing for a power turbine of an electrical generator, it is necessary to seal the gas path. Seals are used to prevent leakage of exhaust gas from the gas path, which reduces efficiency of the power turbine, and to prevent cooling air from entering the gas path, which reduces efficiency of the gas turbine engine. It is therefore desirable to seal, for example, between the fairing and the TEC, as well as between the TEC and the power turbine. However, due to the specific geometries of these various components, it is sometimes necessary to seal across lengthy distances. Finger seals are typically used in such circumstances. In general, a finger seal becomes more inefficient as the gap over which it seals grows. Furthermore, the finger seal can become fatigued if it repeatedly deflects over a long distance. There is, therefore, a need for improved sealing arrangements between structural components in gas turbine engines.

SUMMARY

The present disclosure is directed to a seal system for a gas turbine engine structural frame. The seal system comprises the structural frame, a structural member, a seal and a bumper. The structural member is disposed opposite the structural frame. The seal extends between the structural frame and the structural member. The bumper is anchored to the structural frame or the structural member and extends toward a mid-region of the seal. In one embodiment, the structural frame comprises a ring-strut-ring turbine exhaust case.

DETAILED DESCRIPTION

Figure 1:
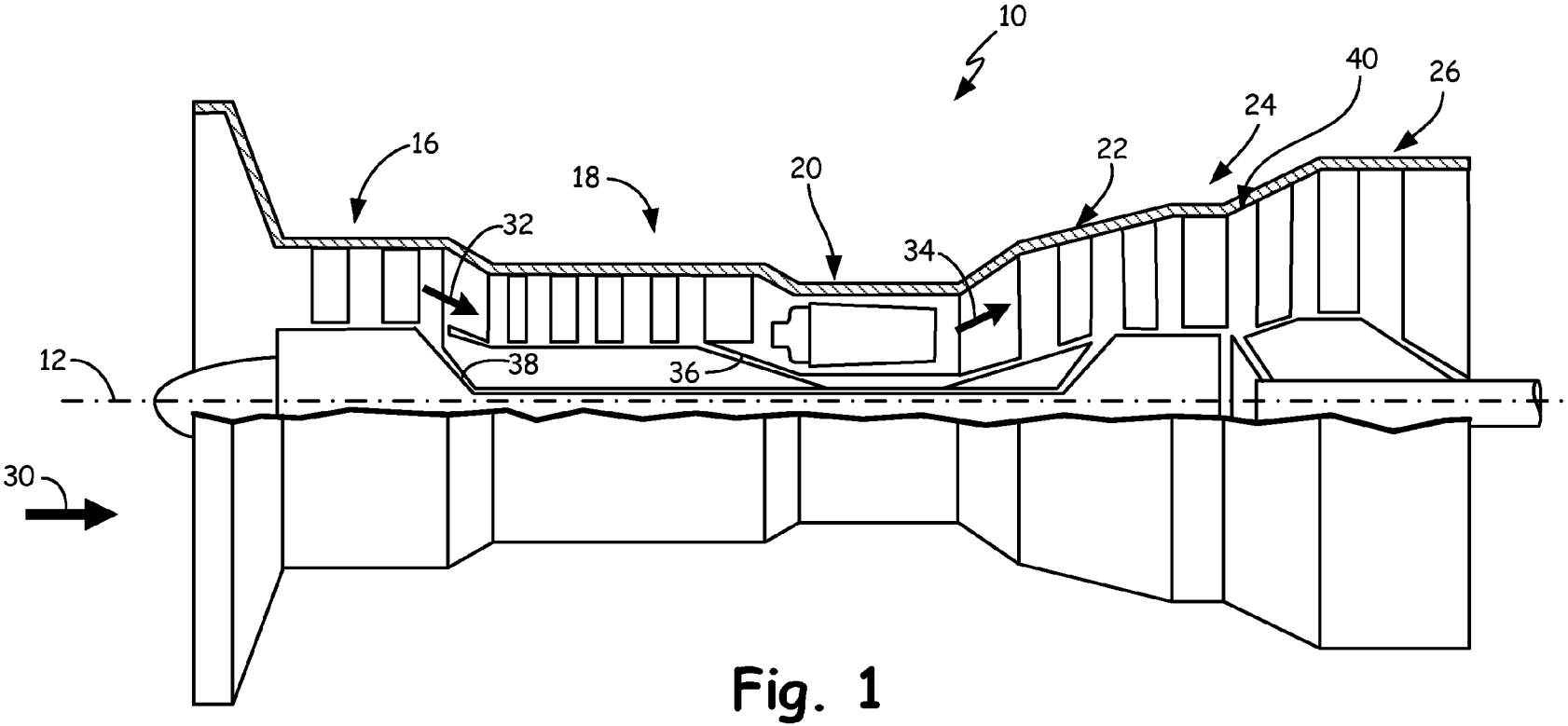
FIG. 1 is a side sectional schematic view of an industrial gas turbine engine having a turbine exhaust case of the present invention.

FIG. 1 is a side partial sectional schematic view of gas turbine engine 10. In the illustrated embodiment, gas turbine engine 10 is an industrial gas turbine engine circumferentially disposed about a central, longitudinal axis or axial engine centerline axis 12 as illustrated in FIG. 1. Gas turbine engine 10 includes, in series order from front to rear, low pressure compressor section 16, high pressure compressor section 18, combustor section 20, high pressure turbine section 22, and low pressure turbine section 24. In some embodiments, power turbine section 26 is a free turbine section disposed aft of the low pressure turbine 24.

As is well known in the art of gas turbines, incoming ambient air 30 becomes pressurized air 32 in the low and high pressure compressor sections 16 and 18. Fuel mixes with pressurized air 32 in combustor section 20, where it is burned. Once burned, combustion gases 34 expand through high and low pressure turbine sections 22 and 24 and through power turbine section 26. High and low pressure turbine sections 22 and 24 drive high and low pressure rotor shafts 36 and 38 respectively, which rotate in response to flow of combustion gases 34 and thus rotate the attached high and low pressure compressor sections 18 and 16. Power turbine section 26 may, for example, drive an electrical generator, pump, or gearbox (not shown).

Low Pressure Turbine Exhaust Case (LPTEC) 40 is positioned between low pressure turbine section 24 and power turbine section 26. LPTEC 40 defines a flow path for gas exhausted from low pressure turbine section 24 that is conveyed to power turbine 26. LPTEC 40 also provides structural support for gas turbine engine 10 so as to provide a coupling point for power turbine section 26. LPTEC 40 is therefore rigid and structurally strong. The present invention relates generally to sealing arrangements between LPTEC 40 and power turbine section 26.

It is understood that FIG. 1 provides a basic understanding and overview of the various sections and the basic operation of an industrial gas turbine engine. It will become apparent to those skilled in the art that the present application is applicable to all types of gas turbine engines, including those with aerospace applications. Similarly, although the present disclosure is described with reference to sealing arrangements for LPTEC 40, the present invention is applicable to other components of gas turbine engines, such as intermediate cases, mid-turbine frames and the like.

Figure 2A:
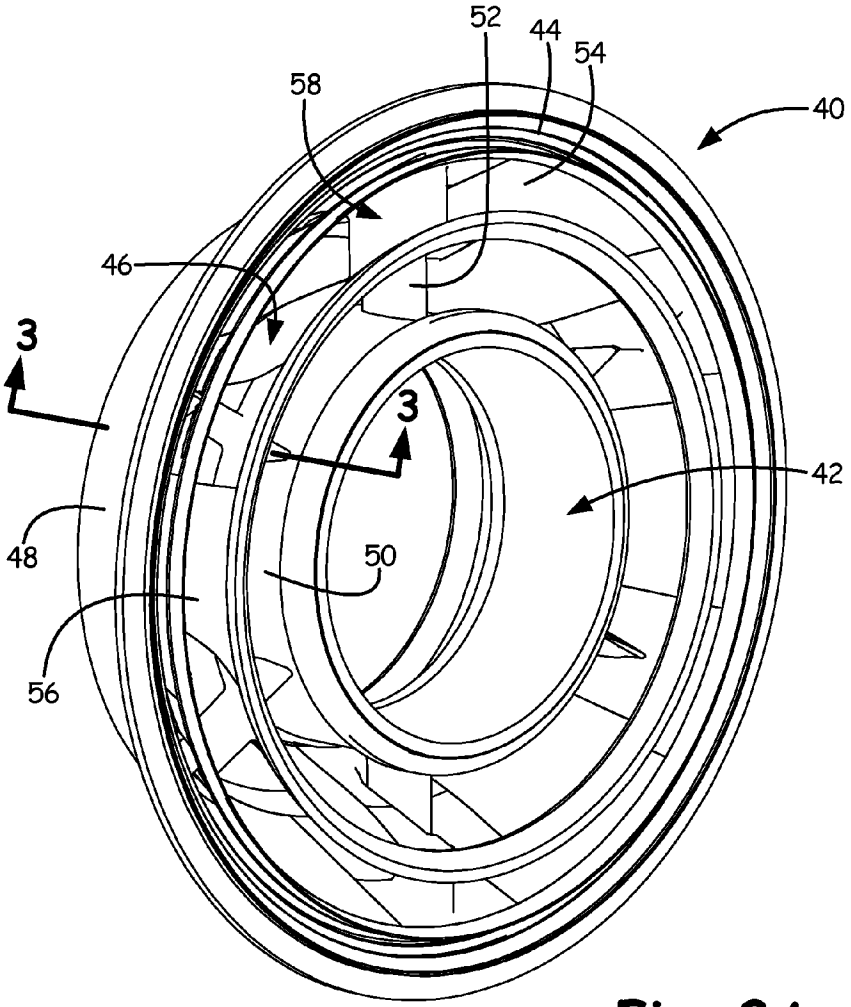
FIG. 2A is a perspective view of a turbine exhaust case in which a ring-strut-ring fairing is assembled with a ring-strut-ring frame.
Figure 2B:
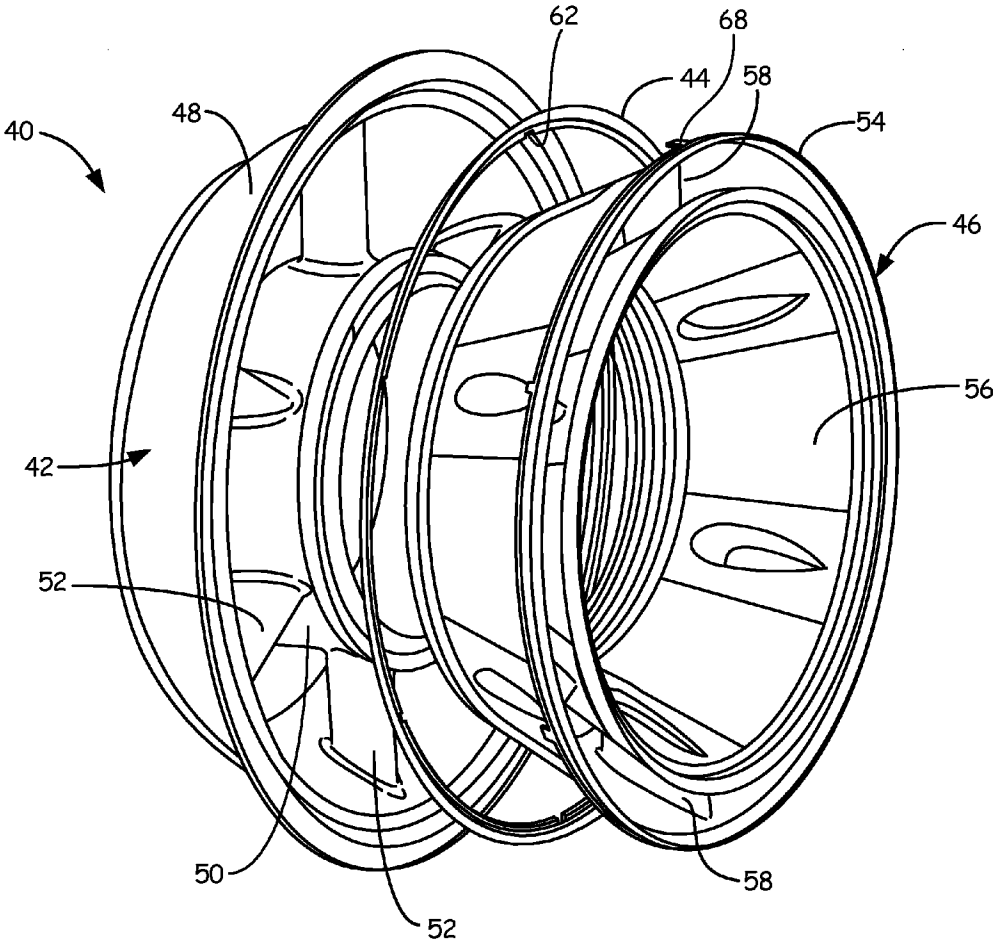
FIG. 2B is an exploded view of the turbine exhaust case of FIG. 2A showing the frame, the fairing and a circumferential stop ring.

FIG. 2A shows a perspective view of Low Pressure Turbine Exhaust Case (LPTEC) 40, which includes frame 42, annular mount 44, and fairing 46. FIG. 2B, which is discussed concurrently with FIG. 2A, shows an exploded view of LPTEC 40 showing annular mount 44 disposed between fairing 46 and frame 42. Frame 42 includes outer ring 48, inner ring 50, and struts 52. Fairing 46 includes outer ring 54, inner ring 56, and struts 58.

Frame 42 comprises a ring-strut-ring structure that defines a gas path between outer ring 48 and inner ring 50. Fairing 46 also comprises a ring-strut-ring structure that is mounted within frame 42 to line the gas path and protect frame 42 from high temperature exposure. In one embodiment, fairing 46 can be built around frame 42, and in another embodiment, frame 42 is built within fairing 46.

Frame 42 comprises a stator component of gas turbine engine 10 (FIG. 1) that is typically mounted between low pressure turbine section 24 and power turbine section 26. In the embodiment shown, outer ring 48 of frame 42 is conically shaped, while inner ring 50 is cylindrically shaped. Outer ring 48 is connected to inner ring 50 via struts 52. Outer ring 48, inner ring 50 and struts 52 form a portion of the gas flow path through gas turbine engine 10 (FIG. 1). Specifically, outer ring 48 and inner ring 50 define the outer and inner radial boundaries of an annular flow path between low pressure turbine section 24 and power turbine section 26 (FIG. 1), while struts 52 intermittently interrupt the annular flow path.

Fairing 46 is adapted to be disposed within frame 42 between outer ring 48 and inner ring 50. Outer ring 54 and inner ring 56 of fairing 46 have generally conical shapes, and are connected to each other by struts 58, which may be vane shaped. Outer ring 54, inner ring 56, and struts 58, form a liner for the portion of the gas flow path through frame 42. Specifically, struts 58 encase struts 52, while outer ring 54 and inner ring 56 line inward facing surfaces of outer ring 48 and inner ring 50, respectively.

Annular mount 44 is interposed between frame 42 and fairing 46 and is configured to prevent circumferential rotation of fairing 46 within frame 42. Annular mount 44 is adapted to be affixed to an axial end of outer ring 48. However, in other embodiments annular mount 44 can be affixed to inner ring 50 or to an intermediate portion of outer ring 48 that is not at or adjacent an axial end thereof. Annular mount 44 is illustrated as a crenellated, full-ring that is adapted to be attached to frame 42. Annular mount 44 comprises a circumferential stop ring. However, in other embodiments, annular mount 44 may be segmented and comprise less than a full ring. Fairing 46 engages annular mount 44 when installed within frame 42. As will be discussed subsequently, fairing 46 and annular mount 44 have mating anti-deflection features, such as slots 62 and lugs 68, that engage to prevent circumferential movement of fairing 46 relative to the frame 42.

Figure 3:
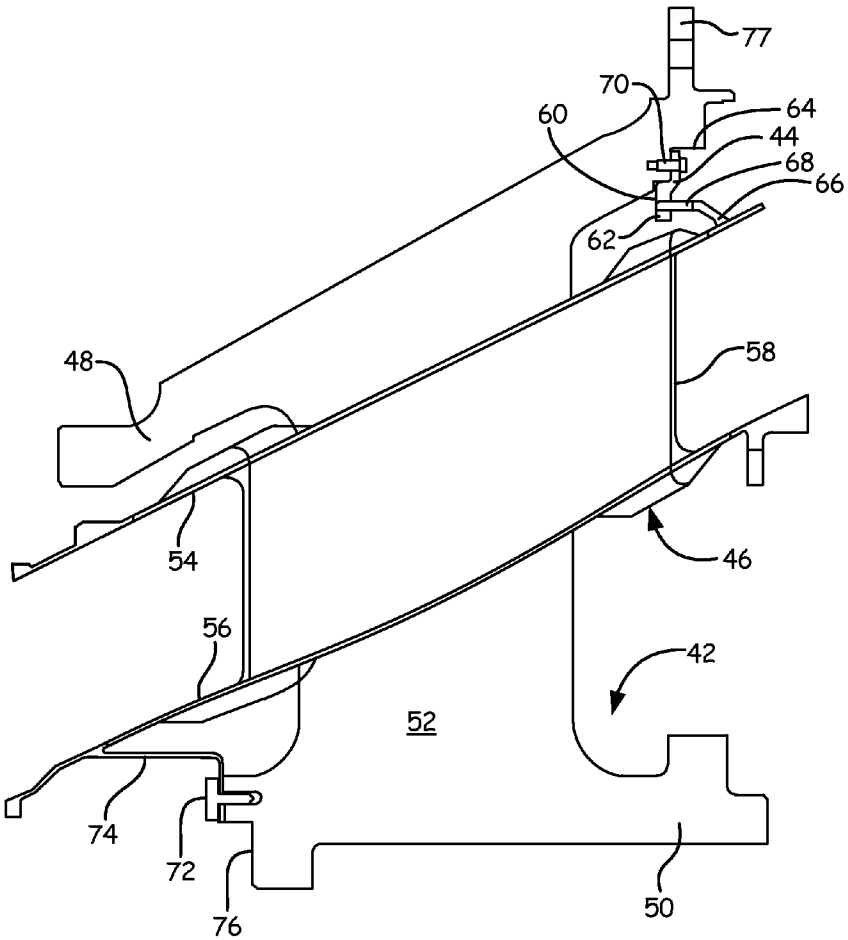
FIG. 3 is a cross-sectional view of the turbine exhaust case of FIG. 2A showing the circumferential stop ring linking the fairing to the frame.

FIG. 3 shows a cross-section of LPTEC 40 having fairing 46 installed within frame 42 utilizing annular mount 44, which includes anti-rotation flange 60 and lugs 62. Frame 42 includes outer ring 48, inner ring 50, strut 52 and counterbore 64. Fairing 46 includes outer ring 54, inner ring 56, strut 58. Outer ring 54 includes anti-rotation flange 66 with lugs 68. LPTEC 40 further comprises fasteners 70, fasteners 72 and mount ring 74.

Frame 42 comprises a structural, ring-strut-ring body wherein strut 52 is connected to outer ring 48 and inner ring 50. As mentioned, outer ring 48 and inner ring 50 define a portion of a flow path for gas exiting gas turbine engine 10 (FIG. 1). Frame 42 also includes other features, such as land 76 and flange 77, to permit frame 42 to be mounted to components of gas turbine engine 10 (FIG. 1), such as low pressure turbine section 24, power turbine section 26 or an exhaust nozzle. Fairing 46 comprises a thin-walled, ring-strut-ring structure that lines the flow path through frame 42. Specifically, outer ring 54 and inner ring 56 define the boundaries of an annular flow path. Struts 58 intermittently interrupt the annular flow path to protect struts 52 of frame 42.

Mount ring 74 extends from inner ring 56 of fairing 46 and engages an axial end of inner ring 50 of frame 42. Mount ring 74 is connected via second fasteners 72 (only one is shown in FIG. 3). Fasteners 72 provide for axial, radial, and circumferential constraint of the axially forward portion of fairing 46 relative to frame 42. Thus, fairing 46 has a fixed connection (i.e., is radially, axially, and circumferentially constrained relative to the frame 42) to frame 42 at a first location.

Fairing 46 has a floating connection (i.e. has axial and radial degrees of freedom) to frame 42 at a second connection through engagement of flange 66 with annular mount 44. Annular mount 44 is attached to an axial end of outer ring 48 by fasteners 70 (only one is shown in FIG. 3). Outer ring 54 of fairing 46 includes flange 66 that engages flange 60 of annular mount 44. Flanges 66 and 60 are castellated to form mating arrays of circumferential slots and lugs. In particular, lugs 68 (only one in shown in FIG. 3) of flange 66 mate with slots 62 (only one in shown in FIG. 3) of flange 60, but allow fairing 46 to move both radially and axially (although only a limited amount) relative to frame 42. Slots 62 are connected to and extend generally radially outward into flange 60. Lugs 68 are connected to and extend generally axially forward from flange 66. Flanges 66 and 60 act to constrain fairing 46 from circumferential movement relative to frame 42 and annular mount 44. Flanges 66 and 60 allow for axial and radial thermal growth and vibration dampening, as needed, to achieve desired component life. Flanges 66 and 60 do not over-constrain fairing 46 since annular mount 44 protects only against circumferential movement of fairing 46 relative to frame 42. In the present invention, components of gas turbine engine 10, such as frame 42 and power turbine section 26, include bumpers that support sealing members, such as finger seals, W-seals and C-seals, extending across gaps between adjacent structural components.

Figure 4:
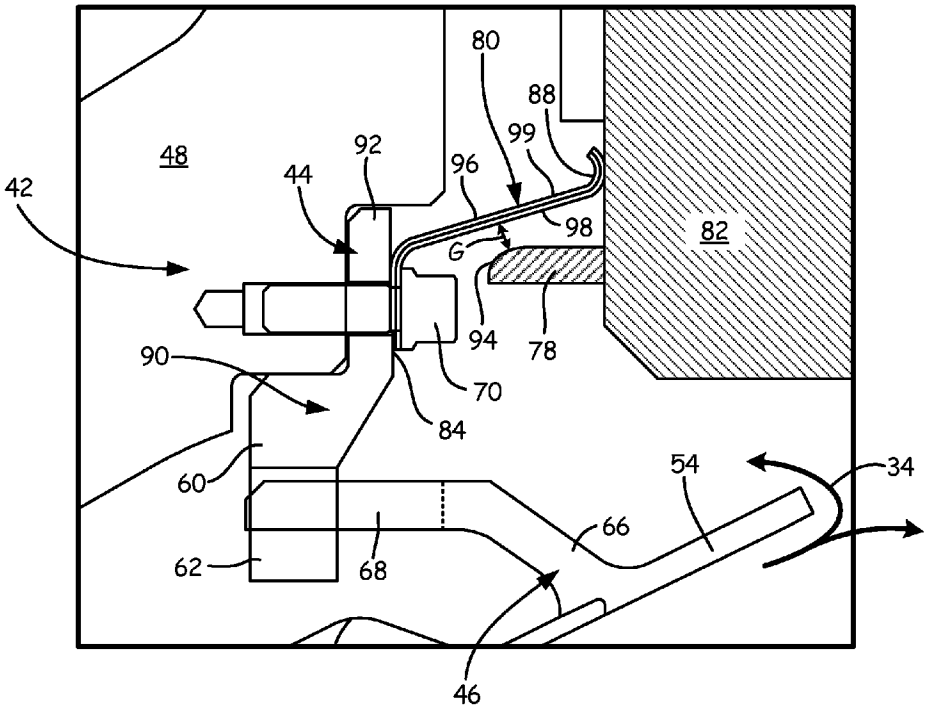
FIG. 4 is a cross-sectional view of a first embodiment of a sealing arrangement for a turbine exhaust case utilizing a bumper extending from a power turbine case.

FIG. 4 is a cross-sectional view of a first embodiment of a sealing arrangement for LPTEC 40 utilizing bumper 78 extending from power turbine case 82. Bumper 78 engages with finger seal 80, which seals between annular mount 44 and power turbine case 82. Power turbine case 82 comprises a stationary component of power turbine section 26 (FIG. 1), such as a structural frame that joins to flange 77 (FIG. 3) of LPTEC frame 42. Combustion gases 34 (FIG. 1) flow through fairing 46 and into power turbine case 82.

Finger seal 80 comprises a full-ring body having first end 84 that is anchored to annular mount 44, such as via fastener 70, and second end 88 that is biased against power turbine case 82. In other embodiments, finger seal 80 may be comprised of a plurality of arcuate segments that are independently coupled to outer ring 48. Finger seal 80 is thin so as to provide a degree of flexibility, thereby enabling finger seal 80 to be deflected when engaged with power turbine case 82 when power turbine section 26 (FIG. 1) is coupled to frame 42. Finger seal 80 is fabricated from any suitable material that is capable of withstanding elevated temperatures, such as metal alloys commonly used in the gas turbine industry. In other embodiments of the invention, finger seal 80 may be replaced with ring-like W-seals or ring-like C-seals, as are known in the art.

Annular mount 44 includes ring body 90, which forms anti-rotation flange 60 and backing plate 92. Ring body 90 comprises a full-ring annular body. Backing plate 92 comprises a full-ring projection, or flange, that extends radially outward from ring body 90. Backing plate 92 includes a plurality of holes to permit mounting of annular mount 44 to frame 42 using fasteners 70. Anti-rotation flange 60 comprises a circumferential projection that extends radially inward from ring body 90. Anti-rotation flange 60 is crenellated so as to provide a plurality of spaced slots 62. As discussed previously, anti-rotation flange 66 of fairing 46 includes a plurality of axially extending lugs 68 that extend into slots 62 to inhibit circumferential rotation of fairing 46 within frame 42.

Bumper 78 comprises a full-ring flange that extends, or projects, from power turbine case 82. However, in other embodiments, bumper 78 may comprise a plurality of circumferentially spaced apart lugs or tabs that extend from power turbine case 82. In the embodiment shown, bumper 78 comprises a separate, non-integral ring that is joined to power turbine case 82, such as by welding or brazing. In other embodiments, such as that of FIG. 5, bumper 78 may be integrally cast with power turbine case 82 or may be machined from power turbine case 82. Bumper 78 includes end 94, which is spaced from mid-section 96 of finger seal 80 across gap G. Thus, bumper 78 comprises a cantilevered beam in which unsupported end 94 is disposed in close proximity to mid-section 96. End 94 is blunted, such as by having a rounded surface, to prevent damaging of finger seal 80 when finger seal 80 contacts bumper 78. End 94 may also be rounded to facilitate rolling of finger seal 80 along the surface of bumper 78, rather than having a point of contact. Seal 80 also includes inner ply 98 and outer ply 99.

Combustion gases 34 are at a higher pressure than ambient air and thus have a tendency to leak from the gas path between frame 42 and power turbine case 82. However, the space between fairing 46 and frame 42 is typically pressurized using compressed air from engine 10 to prevent combustion gases 34 from being ingested into frame 42. Finger seal 80 extends across a gap between outer ring 48 and power turbine case 82 to inhibit combustion gases 34 from leaving the gas path and heating up frame 42 and case 82. Bumper 78 extends toward mid-section 96 of finger seal 80 to prevent deflection of finger seal 80 beyond a threshold amount. In particular, pressure differentials between combustion gases 34 and ambient air cause finger seal 80 to bend. For example, if the pressure of combustion gases 34 drops, finger seal 80 could bend inward towards fairing 46. If left unchecked, finger seal 80 could bend beyond a threshold amount that may cause an undesirable amount of stress in finger seal 80. Bumper 78 prevents finger seal 80 from bending past a point where internal stresses may induce degradation of finger seal 80.

Under another set of operational circumstances, power turbine case 82 may move relative to frame 42. For example, as the gas turbine within power turbine section 26 engages and disengages from operation, power turbine case 82 may move aft and up (with reference to FIG. 4), thereby changing the stress profile within finger seal 80. Specifically, finger seal 80 may become undesirably stressed near first end 84. Bumper 78 is positioned to engage finger seal 80 when power turbine case 82 moves upward to prevent undesirable stresses from forming. Bumper 78 can be configured to engage finger seal 80 at any point between first end 84 and second end 88 to reduce stress within finger seal 80. Bumper 78 is also configured to prevent finger seal 80 from lifting away from power turbine case 82 and breaking the seal between second end 88 and power turbine case 82.

Finger seal 80 may also be constructed for better performance and better wear life. For example, outer ply 99, the non-contact ply, may be fabricated from a stronger material, while inner ply 98, the contact ply, may be fabricated from a more durable material. This would adequately address strength requirements, while also providing durability to protect against wear. In other embodiments of the invention, bumper 78 may extend from annular mount 44 to engage either inner ply 98 or outer ply 99 of finger seal 80, in which case the strength and durability properties of inner ply 98 and outer ply 99 can be reversed. In yet other embodiments, annular mount 44 may be omitted altogether.

Figure 5:
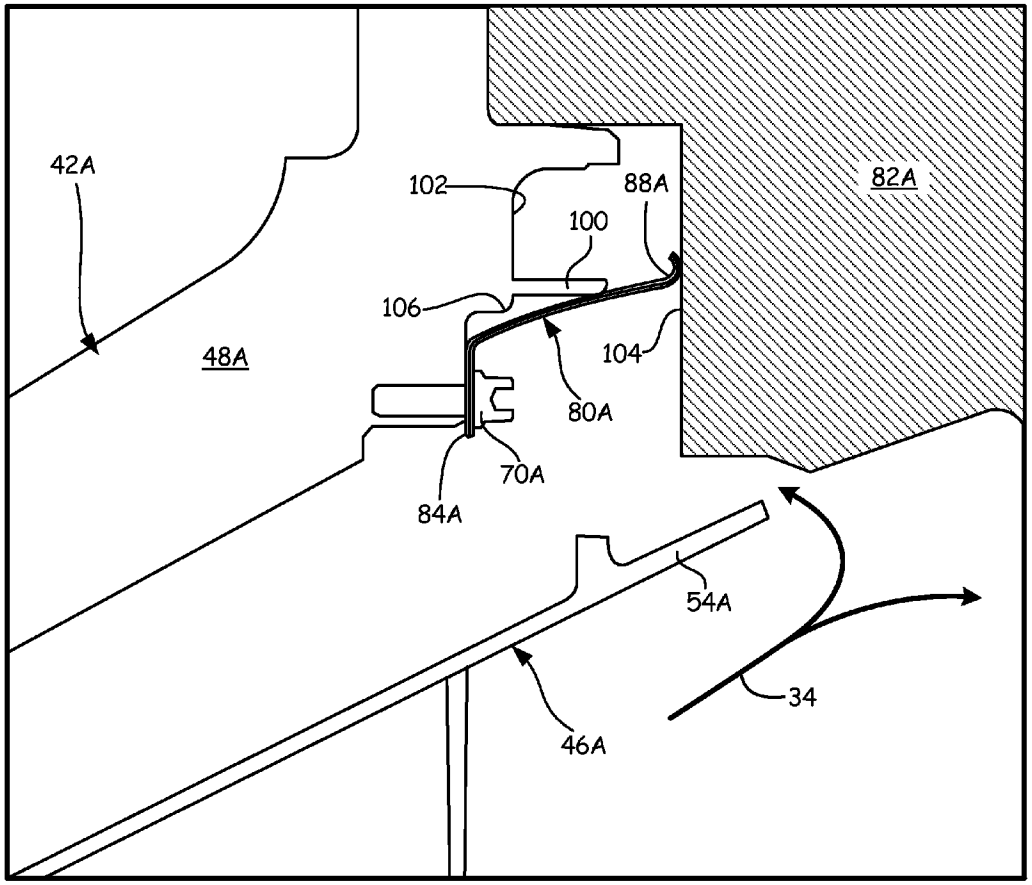
FIG. 5 is a cross-sectional view of a second embodiment of a sealing arrangement for a turbine exhaust case utilizing a bumper extending from a ring of a structural frame.

FIG. 5 is a cross-sectional view of a second embodiment of a sealing arrangement for LPTEC 40 utilizing bumper 100 extending from frame 42A. In the embodiment of FIG. 5, annular mount 44 (FIG. 4) is omitted so that bumper 100 is able to extend from outer ring 48A of frame 42A. As such, finger seal 80A extends directly from frame 42A to power turbine case 82A. Elements of FIG. 5 that are similar as in FIG. 4 include like numbering with an "A" designation.

Bumper 100 comprises an elongate projection extending from frame 42A. Frame 42A includes surface 102, and power turbine case 82 includes surface 104. Surfaces 102 and 104 extend generally vertically with reference to FIG. 5. Finger seal 80A extends across a gap between frame 42A and surface 104 to prevent combustion gases 34 from heating up frame 42A and case 82A. leaking out between frame 42A and power turbine case 82A. Finger seal 80A extends generally diagonally between first surface 102 and second surface 104. Bumper 100 comprises a feature of frame 42A that extends obliquely to finger seal 80A. In one embodiment, surfaces 102 and 104 are parallel and bumper 100 extends perpendicular to surfaces 102 and 104. In other embodiments, bumper 100 may have other shapes, such as a rounded bulge extending from surface 102. In yet other embodiments, bumper 100 may comprise a bend in surface 102, such as bend 106.

Bumper 100 limits deflection of finger seal 80A under adverse pressure conditions. For example, if the pressure of combustion gases 34 increases, finger seal 80A could bend outward towards frame 42A. If left unchecked, finger seal 80A could bend beyond a threshold amount that may cause an undesirable amount of stress in finger seal 80A. Further, finger seal 80A could become separated from power turbine case 82A thereby breaking the seal. Bumper 100 prevents finger seal 80A from bending past a point where internal stresses may induce degradation of finger seal 80A. As such, the service life of finger seal 80A is increased, thereby reducing costs associated with servicing gas turbine engine 10 (FIG. 1).

Discussion of Possible Embodiments

The following are non-exclusive descriptions of possible embodiments of the present invention.

A turbine seal system comprising a structural frame, a structural member disposed opposite the structural frame, a seal extending between the structural frame and the structural member, and a bumper anchored to the structural frame or the structural member and extending toward a mid-region of the seal.

The turbine seal system of the preceding paragraph can optionally include, additionally and/or alternatively, any one or more of the following features, configurations and/or additional components:

A seal comprising a first end coupled to the annular structural frame, and a second end contacting the structural member, wherein the mid-region of the seal is disposed between the first end and the second end.

Bolt holes disposed in the annular structural member, and bolts extending through the first end of the seal and into the bolt holes.

A bumper that is spaced from the mid-region of the seal.

A bumper comprising a cantilevered beam having an unsupported end disposed adjacent the seal.

An unsupported end of the bumper that is rounded at a portion that is configured to engage the seal.

A bumper comprising a flange having a first end extending from the annular structural frame or the structural member, and a second end projecting towards the seal.

A bumper comprising an elongate projection extending from the structural member.

A structural frame comprising an outer diameter ring, an inner diameter ring, and a plurality of struts connecting the inner diameter ring and the outer diameter ring, wherein the bumper extends from the outer diameter ring.

A structural frame comprising a first planar surface, a structural member comprising a second planar surface spaced across a gap from the first planar surface, a seal extending across the gap between the first planar surface and the second planar surface, and a bumper comprising a support feature extending towards the seal.

A circumferential ring joined to the structural frame, wherein the seal extends between the circumferential ring and the structural member.

A fairing disposed within the annular structural frame and engaged with the circumferential ring to limit circumferential rotation of the fairing with respect to the annular structural frame.

A gas turbine engine structural system comprising a gas turbine engine stationary structure comprising: a frame comprising: an outer ring; an inner ring; and a plurality of struts joining the outer ring and the inner ring; and a structural component disposed aft of the frame to form a gap; a seal extending across the gap; and a bumper extending from the gas turbine engine stationary structure to support the seal.

The gas turbine engine structural system of the preceding paragraph can optionally include, additionally and/or alternatively, any one or more of the following features, configurations and/or additional components:

A seal comprising a first end coupled to the frame, a second end contacting the structural component, and a mid-region of the seal disposed between the first end and the second end.

A first end of the seal that is coupled to the outer ring.

Bolt holes disposed in the outer ring, and bolts extending through the first end of the seal and into the bolt holes.

A bumper that is spaced from a mid-region of the seal.

A bumper comprising an elongate flange having a first end connected to the frame, and a second end projecting towards a mid-region of the seal.

A bumper comprising a cantilevered beam having a supported end connected to the structural component, and an unsupported end disposed proximate the seal.

A bumper that is rounded at a free end that is configured to engage the seal.

A frame comprising a first planar surface, a structural component comprising a second planar surface parallel to the first planar surface, a seal extending diagonally between the first planar surface and the second planar surface, and a bumper comprising a feature extending perpendicularly to the first and second planar surfaces.

A seal comprising a first ply facing towards the bumper, and a second ply facing away from the bumper, wherein the first ply is fabricated from a first material different than a second material from which the second ply is fabricated.

A first material that has better wear capabilities than a second material, and a second material that has better strength capabilities than a first material.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A turbine seal system comprising:

a structural frame;

a circumferential ring joined to the structural frame;

a structural member disposed opposite the structural frame;

a fairing disposed within the structural frame and engaged with the circumferential ring to limit circumferential rotation of the fairing with respect to the structural frame;

a seal extending between the structural frame and the structural member, and further extending between the circumferential ring and the structural member; and a bumper anchored to the structural frame or the structural member and extending toward a mid-region of the seal.

2. The turbine seal of claim 1 wherein the seal comprises:

a first end coupled to the structural frame; and a second end contacting the structural member;

wherein the mid-region of the seal is disposed between the first end and the second end.

3. The turbine seal system of claim 2 and further comprising:

bolt holes disposed in the structural member; and bolts extending through the first end of the seal and into the bolt holes.

4. The turbine seal system of claim 1 wherein the bumper is spaced from the mid-region of the seal.

5. The turbine seal system of claim 1 wherein the bumper comprises a cantilevered beam having an unsupported end disposed adjacent the seal.

6. The turbine seal system of claim 5 wherein the unsupported end of the bumper is rounded at a portion that is configured to engage the seal.

7. The turbine seal system of claim 1 wherein the bumper comprises a flange having:

a first end extending from the structural frame or the structural member; and a second end projecting towards the seal.

8. The turbine seal system of claim 1 wherein the bumper comprises an elongate projection extending from the structural member.

9. The turbine seal system of claim 1 wherein the structural frame comprises:

an outer diameter ring;

an inner diameter ring; and a plurality of struts connecting the inner diameter ring and the outer diameter ring;

wherein the bumper extends from the outer diameter ring.

10. The turbine seal system of claim 1 wherein:

the structural frame comprises a first planar surface;

the structural member comprises a second planar surface spaced across a gap from the first planar surface;

the seal extending across the gap between the first planar surface and the second planar surface; and the bumper comprises a support feature extending towards the seal.

11. A gas turbine engine structural system comprising:

a gas turbine engine stationary structure comprising:

a frame comprising:

an outer ring;

an inner ring; and a plurality of struts joining the outer ring and the inner ring; and a structural component disposed aft of the frame to form a gap;

a seal extending across the gap;

a circumferential ring joined to the frame;

a fairing disposed within the frame and engaged with the circumferential ring to limit circumferential rotation of the fairing with respect to the frame; and a bumper extending from the gas turbine engine stationary structure to support the seal.

12. The gas turbine engine structural system of claim 11 wherein the seal comprises:

a first end coupled to the frame;

a second end contacting the structural component; and a mid-region of the seal disposed between the first end and the second end.

13. The gas turbine engine structural system of claim 12 wherein the first end of the seal is coupled to the outer ring.

14. The gas turbine structural system of claim 13 and further comprising:

bolt holes disposed in the outer ring; and bolts extending through the first end of the seal and into the bolt holes.

15. The gas turbine structural system of claim 11 wherein the bumper is spaced from a mid-region of the seal.

16. The gas turbine structural system of claim 11 wherein the bumper comprises an elongate flange having:

a first end connected to the frame; and a second end projecting towards a mid-region of the seal.

17. The gas turbine structural system of claim 11 wherein the bumper comprises a cantilevered beam having:

a supported end connected to the structural component; and an unsupported end disposed proximate the seal.

18. The gas turbine structural system of claim 11 wherein the bumper is rounded at a free end that is configured to engage the seal.

19. The gas turbine structural system of claim 11 wherein:

the frame comprises a first planar surface;

the structural component comprises a second planar surface parallel to the first planar surface;

the seal extends diagonally between the first planar surface and the second planar surface; and the bumper comprises a feature extending perpendicularly to the first and second planar surfaces.

20. The gas turbine structural system of claim 11, wherein the seal comprises:

a first ply pacing towards the bumper; and a second play facing away from the bumper;

wherein the first ply is fabricated from a first material different than a second material from which the second play is fabricated.

21. The gas turbine structural system of claim 20 wherein:

the first material has better wear capabilities than the second material; and the second material has better strength capabilities than the first material.

* * * * *